United States Patent [19]

Kaeppner

[11] 4,341,156

[45] Jul. 27, 1982

[54] DILITHO PRINTING IMAGE HEATING

[75] Inventor: Werner M. Kaeppner, Prescott, Canada

[73] Assignee: CIP Inc., Quebec, Canada

[21] Appl. No.: 182,168

[22] Filed: Aug. 28, 1980

[51] Int. Cl.[3] ..... B41M 1/06; B41L 25/00; B41F 7/00

[52] U.S. Cl. ..... 101/141; 101/451; 101/147

[58] Field of Search ..... 101/451, 141, 142, 147, 101/132.5, 450.1

[56] References Cited

U.S. PATENT DOCUMENTS

| | | | |
|---|---|---|---|
| 1,958,311 | 5/1934 | Mehl | 101/451 |
| 2,106,732 | 2/1938 | Goedike | 101/147 |
| 2,398,288 | 4/1946 | Collins | 101/132.5 |
| 2,678,001 | 5/1954 | Davidson | 101/147 |
| 2,735,364 | 2/1956 | Muller | 101/142 |
| 3,230,106 | 1/1966 | West | 101/426 |
| 3,630,149 | 12/1971 | Etter | 101/450.1 |
| 3,989,569 | 11/1976 | Newman | 101/450.1 |
| 4,057,016 | 11/1977 | Endo | 101/467 |

*Primary Examiner*—Clyde I. Coughenour

*Attorney, Agent, or Firm*—Burns, Doane, Swecker and Mathis

[57] ABSTRACT

Selective reduction in ink tackiness resulting in better ink transfer with less print through better image reproduction fidelity, less plate wear, less waste of paper, and less linting may be accomplished by selective warming of the image areas on the printing plates prior to application.

5 Claims, 2 Drawing Figures

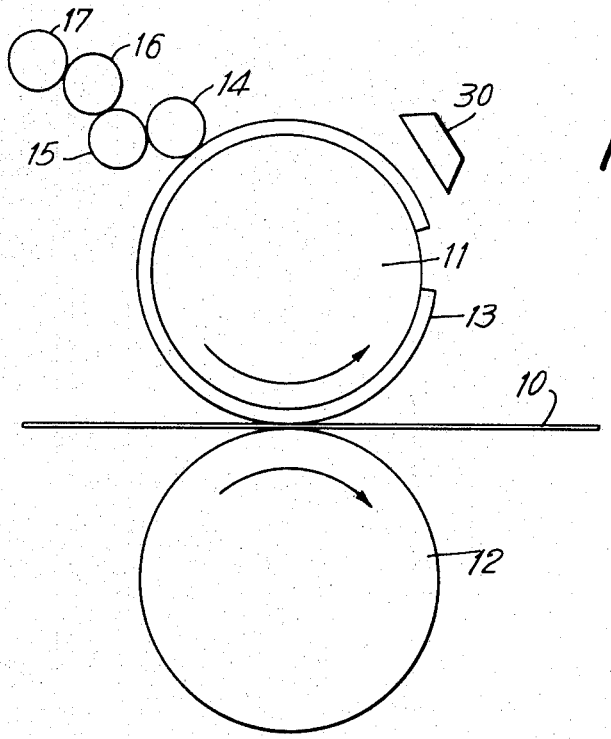
FIG. 1
FIG. 2
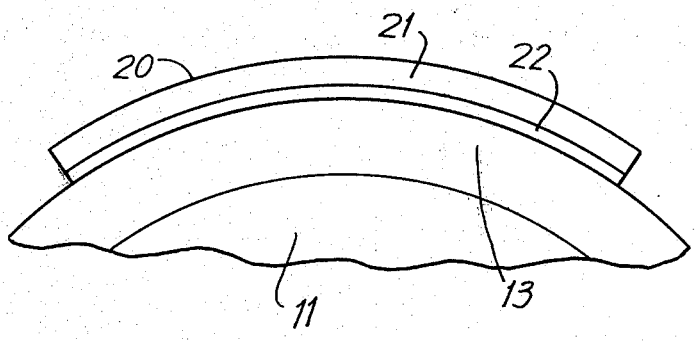

DILITHO PRINTING IMAGE HEATING

BACKGROUND OF THE INVENTION

This invention is related to the art of DiLitho printing and to improvements in apparatus therefor.

The DiLitho printing process was developed about 1968 by the American Newspaper Publishers Association Research Institute in an effort to help obtain for those printing plants which had large investments in continuous letterpress printing equipment some of the advantages which were then appearing for offset printing such as the ability to utilize photocomposition and its attendant cost savings. This process operates in a fashion analogous that of offset in that ink is supplied to a substantially flat oleophilic (hydrophobic) image area on a carrier preferably cylindrical, for continuous operation, while an aqueous fountain solution is supplied to hydrophilic non-image areas. However, the image is transferred as in letterpress operation directly from the inked image to the paper web. The conversion of existing continuous letterpress units is thus facilitated because the plate cylinder merely needs the DiLitho plates fastened on in place of letterpress image plates, a fountain solution application train must be added, and the inking system requires relatively minor modifications to accommodate the new ink and fountain solution applicator. This conversion is far less costly than the entire replacement of a letterpress unit with an offset unit.

Although the above advantages have led to fairly widespread commercial use of this process a number of problems remain. These are the potential for poor print quality because of inadequate ink transfer, a high volume of start-up waste because of slow initial inking of the plates (as much as 4% of the paper), susceptibility to linting requiring frequent shut downs for wash-ups, and, since the plate contacts the paper web directly, wear on the printing plate limits the number of impressions obtainable from a plate.

Certain improvements in these characteristics may be employed by running the process at higher temperatures but just as in regular offset this increases problems with ink and fountain solution mixing reducing print definition and leading to background shading and also with ink print through on the paper because of the lowered ink viscosity.

CITATION OF RELEVANT LITERATURE

Canadian Pat. No. 1,020,807 discloses an improved off-set process wherein the ink on the press roller is maintained at normal ambient operating temperature and is warmed by about 30° F. above that temperature on the press blanket roller. The paper web is warmed about 10° to aid in moisture evaporation. No teaching of temperature stratification of the ink, the means of effecting this for a DiLitho system or of the advantages accruing therefrom are suggested.

German Auslegeschrift No. 1,179,225 discloses a heating device for ink in a printing press. The purpose is to generally lower the viscosity of the ink to provide for its improved movement, for example, pumping. No teaching of temperature stratification of the ink, how this can be accomplished in a DiLitho process or of the advantages accruing therefrom are suggested.

U.S. Pat. No. 2,260,364 discloses a heated roller process for letterpress printing. Although some temperature stratification might occur early in the distribution system, the system seems designed to provide a uniform ink temperature at the printing stage. In any case letterpress teachings are not considered apt for DiLitho or offset processes.

U.S. Pat. No. 2,735,364 teaches infra red heating of the press blanket roll to evaporate residual water and fluidize ink for easier transfer. Heated inking rollers are also suggested. No temperature stratification for DiLitho processes, no suggestion of an appropriate mechanical arrangement to achieve this or the results to accrue therefrom are suggested.

U.S. Pat. No. 3,741,115 teaches the application of ink to a lithographic press plate at two different temperatures. The arrangement taught will not provide a temperature stratified ink on the blanket roll in a fashion corresponding to applicant's stratified ink on a DiLitho printing roll from where it is transferred directly to the paper.

U.S. Pat. No. 3,956,986 teaches alternate heating and cooling the fountain roller of a lithographic process. This clearly is remote from applicant's invention. Other background patents of which applicant is aware are U.S. Pat. Nos. 1,874,427; 2,375,660; 3,669,706 and 3,885,496. These are believed more remote than those discussed.

Some background literature on the DiLitho process of which applicant is aware is:

"The MAN dilitho System", Newspaper Tech., December 1976, pp. 45–46;

"Taking that First Step Toward Offset", Jeremiah E. Flynn, July–August 1975, Newspaper Production, p. 34;

"The Exciting World of DiLitho Research", Erwin Jaffe, June 1976, Newspaper Production, p. 14;

"Goss Di-Litho Best Bet for Big Dailies" (advertisement), June 1976, Newspaper Production, p. 15;

"DiLitho: Major Contender", Erwin R. Jaffe, September 1976, Newspaper Production, p. 3;

"Dampening Systems of Major Importance in Direct Litho", September 1976, Newspaper Production, p. 6;

"Roll Copperizing needed for Quality Direct Litho Work", September 1976 Newspaper Production, P. 10;

"DiLitho Quality Compared with Offset, Letterpress", Louis S. Tyma, September 1976, Newspaper Production, p. 14;

"An Overall Look at DiLitho", Erwin Jaffe, NAPA/RI Research Center Report, Bulletin 1258, p. 77, Apr. 6, 1977.

SUMMARY OF THE INVENTION

The invention provides in a DiLitho printing apparatus wherein hydrophobic ink is provided to hydrophobic image areas on a printing plate and an aqueous fountain solution is supplied to hydrophilic non-image areas on said printing plate the improvement comprising providing a source of radiant heat energy to said printing plate at a point prior to application of said ink and said fountain solution and after transfer of ink supplied in a previous cycle from said image area of said printing plate to a web on which it is desired to transfer said ink to enable selectively warming the surface of said image area.

This improved apparatus aspect of the invention possesses the inherent applied use characteristic of permitting the formation of a temperature gradient by warming the layers of ink adjacent the plate while leaving the layers of ink remote from the printing plate at about the ambient temperature of their application. The colder layer of ink is then applied directly to the web and because of its inherently higher viscosity "print through" of the ink is retarded. The warm layer adjacent the plate cylinder because of its inherently lower viscosity makes easier more complete release and transfer of the ink from the image area of the plate cylinder to the web.

The invention also provides in a DiLitho printing process wherein hydrophobic ink is provided to at least one hydrophobic image area on a printing plate, an aqueous fountain solution is provided to at least one hydrophilic non-image area on said printing plate and said printing plate is rotated in contact with and at a circumferential speed substantially identical to the linear speed of a web so as to transfer said ink from said printing plate image area to said web thereby leaving an image of said image area on said web the improvement wherein heat energy is provided to said image area after the transfer of said ink to said web and prior to provision of fresh ink to said image area so that said ink is maintained substantially at its application temperature on its outer surface and at an elevated temperature adjacent its surface contacting said image area.

BRIEF DESCRIPTION OF THE DRAWINGS

FIG. 1 is a schematic view of a simple DiLitho printing press employing a means for selectively heating the image areas on the printing plate and hence the layer of ink immediately contacting or adjacent to such image areas in accordance with this invention.

FIG. 2 is a schematic, not to scale, representation of the temperature gradient formed in an ink film deposited on an image area on the printing plate of a DiLitho printing apparatus, said image area having been heated in accord with this invention.

DESCRIPTION OF THE PREFERRED EMBODIMENTS

The manner of practicing the invention will now be described with reference to FIGS. 1 and 2.

FIG. 1 is a schematic illustration of a simple DiLitho printing press 1. In operation of the printing press 1, a paper web 10 is passed between the nip of a plate cylinder 11 and an impression cylinder 12. As the paper 10 passes between the plate cylinder 11 and the impression cylinder 12, it is printed with an ink image by a printing or DiLitho plate 13 on the plate cylinder 11.

The press 1 shown in the drawing prints on one side of the paper 10. One skilled in the art will recognize that high speed presses which print simultaneously on both sides of paper with pairs of plate cylinders 11 having attached printing or DiLitho plates 13 and impression cylinders 12 may also be utilized in the practice of the invention and are contemplated as full equivalents herein and in the appended claims.

In accordance with the DiLitho printing process of this invention, the plate cylinder 11, the impression cylinder 12, and the DiLitho plate 13 can be conventional elements of DiLitho printing presses such as those discussed in the literature referenced hereinabove. The impression cylinder 12 can be any conventional natural or synthetic rubber covered roller adapted to maintain pressure against the paper 10 and hold the paper 10 against the DiLitho plate 12 and plate cylinder 11. The plate cylinder 11 can be any conventional roller, conveniently in many cases a rotary letterpress roller adapted, if necessary, to hold a DiLitho plate having hydrophilic background areas and hydrophobic image areas and adapted to receive ink and water and to transfer an ink image directly to a paper web.

The plate cylinder 11 rotates through a full cycle, carrying the DiLitho plate 13 thereon through inking and wetting stations or a combined inking-wetting station. In FIG. 1 these stations are represented schematically by transfer rollers 14, 15, 16, and 17. One skilled in the art will recognize that any conventional arrangement of ink and fountain solution transfer rolls will be equivalent for the purposes of this invention and that all such conventional arrangements are contemplated as such equivalents. These transfer rollers 14, 15, 16, and 17 serve to transport ink and aqueous fountain solution from a conventional ink fountain 18 (not shown) and from a conventional water fountain 19 (not shown) respectively to simultaneously wet and ink the DiLitho plate 13.

In the operation of the simple DiLitho printing press 1, ink is transferred continuously via the transfer rollers 14, 15, 16, and 17 from the ink fountain 18 to the surface of the DiLitho plate 13. Fountain solution is similarly transferred from the water fountain 19. The ink is transferred to the hydrophobic image areas of the DiLitho plate 13 and at the same time aqueous fountain solution is transferred to the hydrophilic non-image background areas on the DiLitho plate 13. As the plate cylinder 11 passes through its cycle it causes the DiLitho plate 13 to contact the paper 10. At least part of the ink is thereby transferred to the paper 10 at the nip between the plate cylinder 11 and the impression cylinder 12.

As seen from the foregoing, the basic elements and cooperation of the parts of the DiLitho printing press 1, shown in FIG. 1, are conventional. However, in accordance with this invention, it has been discovered that, by providing a source of radiant heat energy 30 at the plate cylinder 11 on a point on its cycle of rotation after it has contacted the paper 10 and before the reinking and rewetting stations described hereinabove, selective warming of the image areas on the DiLitho plate 13 relative to the non-image areas is attainable. This selectivity is possible because the image areas are normally dark and therefore absorptive of radiation and contrast with the light colored normally metallic surfaced non-image areas which are therefore reflective of radiation.

Turning now to FIG. 2 which is a schematic view of an ink layer 20 as it would appear on an image area supported on DiLitho plate 13 which is in turn supported on plate cylinder 11 after receiving a fresh inking from transfer roller 14. The non-image areas would naturally also be covered with a fresh layer of fountain solution, but for clarity this layer has been omitted. The ink film 20 is substantially comprised of two layers defined by a temperature gradient between them. These layers are an upper layer 21 and a lower layer 22. The upper layer 21 will comprise the major portion of the newly deposited ink film and will be at about the temperature of the ink when deposited from transfer roller 14 that is about normal temperature of the air surrounding the vicinity of press 1 when press 1 is in operation. Lower layer 22 will comprise residual ink remaining on the surface of the image area on plate 13 after the previous cycle of operation and which has been warmed to a temperature greater than ambient by passage under heater 30. One skilled in the art will recognize that the lower layer of ink 22 will have a lower viscosity than the ink in upper layer 21. Ink layer 20 will therefore transfer more readily to web 10 due to the presence of layer 22 but because layer 21 will be in contact with the surface of web 10, the lower viscosity of layer 21 will reduce any tendency on the part of ink layer 20 to flow through the web (print-through) or to diffuse at the edge.

As stated herein use of conventional equipment is contemplated in the practice of the invention, that is, the DiLitho press equipment may be any known to the art and it may be operated within the normal operating parameters of such equipment. Similarly, the radiant or infra red heating unit to be positioned as herein described in such conventional DiLitho equipment may be any conventional infra red equipment which will provide adequate flux of infra red energy across the whole surface of the DiLitho plate 13 to provide the desired temperature to ink layer 22. Such equipment is readily selected from commercially available infra red heating devices or is readily constructed by one skilled in the art.

The ambient temperature of the air in the vicinity of the press 1 during operation thereof will normally be in the range of 68° to 78° F. with about 72° F. being preferred. As stated herein above this is also the desired range of temperatures and the preferred temperature of the ink for transfer from roller 14 to the image areas on DiLitho plate 13. The temperature range above ambient of ink layer 22 will range from about 10° to 50° greater than that of the ink as applied from roller 14 with temperatures about 98° F. being preferred.

One skilled in the art will also recognize that conventional lithographic ink and fountain solutions may be employed in the practice of this invention. Some machines known in the art are also capable of using conventional letterpress ink and such machines and inks are also contemplated as full equivalents by this invention.

Although the operation of the invention has been described with reference to a paper web, webs of materials, such as woven or non-woven textiles, other than conventional paper will readily occur to one of skill in the art. The use of such equivalent webs is contemplated as an aspect of this invention and such equivalent webs are contemplated as full equivalents of the paper web described in the practice thereof.

The subject matter which applicant regards as his invention is particularly pointed out and distinctly claimed as follows:

1. In a DiLitho printing press wherein hydrophobic ink is provided to hydrophobic image areas on a printing plate and an aqueous fountain solution is provided to hydrophilic non-image areas on said printing plate, and wherein said image areas are dark and absorptive of radiation and said non-image areas are light and reflective of radiation, the improvement comprising providing radiant heating source means to said plate cylinder, at a point prior to application of said ink and said fountain solution and after transfer of ink supplied in a previous cycle from said image areas to a web on which it is desired to transfer said ink, to warm selectively said image areas, said radiant heating source means being such as to warm said image areas to from 10° F. to 50° F. above the ambient temperature prior to inking.

2. A DiLitho printing press as defined in claim 1 wherein the web is a paper web.

3. In a DiLitho printing process wherein hydrophobic ink is provided to at least one hydrophobic image area on a printing plate, an aqueous fountain solution is provided to at least one hydrophilic non-image area on said printing plate and said printing plate is rotated in contact with and at a circumferential velocity substantially identical to the linear velocity of a web so as to imagewise transfer said ink from said plate to said web, said image areas being dark and absorptive of radiation and said non-image areas being light and reflective of radiation, the improvement comprising exposing said printing plate to radiant heat and thereby selectively warming said hydrophobic image areas after transfer of ink to said web and prior to reapplication of ink to said image areas, said radiant heating being such as to warm said image areas to from 10° F. to 50° F. above the ambient temperature prior to inking.

4. A process as defined in claim 3 wherein the web is a paper web.

5. A process as claimed in claim 3 wherein the ink characteristics are such that when ink has been applied to said warmed image areas an inner layer of ink adjacent the printing plate has a lower viscosity than an outer layer of ink freshly applied to the printing plate by virtue of warmth received by said inner layer from the warmed image areas.

* * * * *